US006926650B2

(12) United States Patent
Endelman et al.

(10) Patent No.: US 6,926,650 B2
(45) Date of Patent: Aug. 9, 2005

(54) COLLAPSIBLE REFORMER EXERCISE APPARATUS

(75) Inventors: Ken Endelman, Sacramento, CA (US); Brian Janowski, Marquette, MI (US)

(73) Assignee: Balanced Body, Inc., Sacramento, CA (US)

( * ) Notice: Subject to any disclaimer, the term of this patent is extended or adjusted under 35 U.S.C. 154(b) by 649 days.

(21) Appl. No.: 10/035,842

(22) Filed: Dec. 24, 2001

(65) Prior Publication Data

US 2002/0058573 A1 May 16, 2002

Related U.S. Application Data

(63) Continuation-in-part of application No. 09/835,204, filed on Apr. 12, 2001, now Pat. No. 6,527,685, which is a continuation of application No. 09/521,555, filed on Mar. 9, 2000, now Pat. No. 6,371,895, which is a continuation of application No. 09/275,555, filed on Mar. 25, 1999, now Pat. No. 6,186,929, which is a continuation of application No. 09/266,286, filed on Mar. 11, 1999, now abandoned.

(51) Int. Cl.[7] ..... A63B 21/00

(52) U.S. Cl. ..... 482/121; 482/122; 482/129

(58) Field of Search ..... 482/72, 51, 52, 482/71, 70, 95, 96, 54, 56, 121, 122, 129

(56) References Cited

U.S. PATENT DOCUMENTS

| | | | | |
|---|---|---|---|---|
| 339,638 | A | 4/1886 | Goldie | |
| 1,621,477 | A | 3/1927 | Pilates | |
| 1,738,987 | A | 12/1929 | Dattilo | |
| 1,750,549 | A | 3/1930 | Thomson et al. | |
| 1,979,783 | A | 11/1934 | Williams et al. | |
| 1,980,036 | A | 11/1934 | Casler et al. | |
| 2,733,922 | A | 2/1956 | Diego | |
| 3,261,606 | A | 7/1966 | Elia et al. | |
| 3,586,322 | A * | 6/1971 | Keverneland | 482/72 |
| 3,770,267 | A | 11/1973 | McCarthy | |
| 3,892,404 | A | 7/1975 | Martucci | |
| 4,084,815 | A | 4/1978 | Flannery | |
| 4,272,074 | A | 6/1981 | Sferle | |
| 4,290,600 | A | 9/1981 | Kolbel | |
| 4,357,010 | A | 11/1982 | Telle | |
| 4,376,533 | A | 3/1983 | Kolbel | |
| 4,383,684 | A | 5/1983 | Schliep | |

(Continued)

FOREIGN PATENT DOCUMENTS

| | | |
|---|---|---|
| DE | 2944599 | 5/1981 |
| FR | 1470421 | 1/1967 |
| FR | 2 481 125 | 4/1980 |
| FR | 2625907 | 7/1989 |
| WO | WO 86/01735 | 3/1986 |

*Primary Examiner*—Jerome W. Donnelly
(74) *Attorney, Agent, or Firm*—John R. Wahl; Merchant & Gould PL

(57) ABSTRACT

An exercise apparatus comprising a generally rectangular extruded aluminum alloy frame having a head end and a foot end and including a pair of spaced apart parallel track members wherein the head end, the foot end, and the track or rail members are each formed from the metal extrusion material. The apparatus includes a movable carriage made of a rigid frame that moves along the rail members between the head and foot ends against one or more resistance members connected to the carriage and the foot end of the frame. Each of the rail members includes a longitudinal slot therein for receiving a foot support bar assembly. The rail members and head and foot end members are generally each metal tubular box extrusions and the rail members telescopically retract. Roller wheels attached to the carriage move along the top of the rail members and guide wheels move along the inside of the rail members. The invention further includes shoulder stops on the carriage that can be adjusted to a horizontal position so that the apparatus may be compactly stored.

21 Claims, 9 Drawing Sheets

U.S. PATENT DOCUMENTS

| | | | | | |
|---|---|---|---|---|---|
| 4,517,966 | A | | 5/1985 | von Othegraven | 128/75 |
| 4,684,121 | A | * | 8/1987 | Nestegard | 482/70 |
| 4,700,945 | A | | 10/1987 | Rader | |
| 4,706,953 | A | | 11/1987 | Graham | |
| 4,709,918 | A | | 12/1987 | Grinblat | 272/97 |
| 4,768,776 | A | | 9/1988 | Giannotti | |
| 4,775,150 | A | | 10/1988 | Graham | |
| 4,776,583 | A | | 10/1988 | Jennings | 272/73 |
| 4,884,802 | A | | 12/1989 | Graham | |
| 4,911,438 | A | | 3/1990 | Van Straaten | |
| 4,974,832 | A | | 12/1990 | Dalebout | |
| 5,014,966 | A | | 5/1991 | Wang | 267/64 |
| 5,024,214 | A | | 6/1991 | Hayes | |
| 5,042,797 | A | * | 8/1991 | Graham | 482/96 |
| 5,066,005 | A | | 11/1991 | Luecke | |
| 5,207,628 | A | | 5/1993 | Graham | 482/140 |
| 5,263,913 | A | | 11/1993 | Boren | |
| 5,338,278 | A | | 8/1994 | Endelman | |
| 5,352,169 | A | | 10/1994 | Eschenbach | 482/57 |
| 5,364,327 | A | | 11/1994 | Graham | |
| D354,780 | S | | 1/1995 | Endelman | |
| D354,781 | S | | 1/1995 | Endelman | |
| 5,423,729 | A | | 6/1995 | Eschenbach | 482/70 |
| D362,700 | S | | 9/1995 | Breibart et al. | |
| 5,529,554 | A | | 6/1996 | Eschenbach | 482/57 |
| 5,580,340 | A | | 12/1996 | Yu | 482/96 |
| 5,607,381 | A | | 3/1997 | Endelman | |
| 5,653,670 | A | | 8/1997 | Endelman | |
| 5,681,249 | A | | 10/1997 | Endelman | |
| 5,722,917 | A | * | 3/1998 | Olschansky et al. | 482/72 |
| 5,792,033 | A | | 8/1998 | Merrithew | 482/96 |
| 5,795,271 | A | | 8/1998 | Pearson | 482/72 |
| 5,807,217 | A | | 9/1998 | Endelman | |
| 5,816,981 | A | | 10/1998 | Hung | 482/54 |
| 5,853,357 | A | | 12/1998 | Jones, Jr. | 482/140 |
| 6,179,759 | B1 | | 1/2001 | Tellone | 482/111 |
| 6,186,929 | B1 | | 2/2001 | Endelman et al. | 482/121 |
| 6,206,530 | B1 | | 3/2001 | Eberts | 359/879 |

* cited by examiner

COLLAPSIBLE REFORMER EXERCISE APPARATUS

CROSS REFERENCE TO RELATED APPLICATIONS

This application is a continuation in part of U.S. patent application Ser. No. 09/835,204, filed on Apr. 12, 2001, now U.S. Pat. No. 6,527,685, which is a continuation-in-part of U.S. patent application Ser. No. 09/521,555, filed on Mar. 9, 2000, now U.S. Pat. No. 6,371,895, which is a continuation-in-part of U.S. patent application Ser. No. 09/275,755, filed Mar. 25, 1999, now U.S. Pat. No. 6,186,929 which is also a continuation-in-part of U.S. patent application Ser. No. 09/266,286, filed Mar. 11, 1999, now abandoned, all four of which are hereby incorporated by reference in their entirety.

BACKGROUND OF THE INVENTION

1. Field of the Invention

This invention relates generally to the field of exercise equipment in which a movable carriage is utilized to at least partially support a user's body, commonly referred to as a "reformer", and more particularly to a telescopically collapsible reformer with a rigid frame carriage.

2. Description of the Related Art

Joseph H. Pilates, in U.S. Pat. No. 1,621,477, originally developed the concept of using a wheeled platform carriage connected to a resistance device such as a set of weights in conjunction with a stationary frame to provide a variable resistance against which a user could push with his/her feet or pull with the arms while in a sitting or recumbent position in order to exercise the major muscle groups of the user's trunk, legs and/or arms. Since that time Joseph Pilates developed many changes and improvements in the design of such an apparatus, and more recently, have been evolved by his students and others. U.S. Pat. No. 5,066,005 and my patents referred to above are representative of the current state of evolutionary development of these changes that have taken place since 1927.

The current conventional "reformer" type apparatus includes a wheeled platform carriage, which rides on a rectangular wooden or metal frame. The above referenced patent discloses examples of wood framed reformers. An example of a metal frame reformer is disclosed in U.S. Pat. No. 5,792,033 to Merrithew. The carriage, which rides on the frame, is connected to a series of parallel springs or elastic members, which are in turn connected to a foot end of the rectangular frame. The carriage typically rides on parallel rails or tracks typically mounted to the inside of the longer sides of the rectangular frame. This carriage has a flat, padded upper surface and typically includes a pair of spaced, padded, upright shoulder stops and a headrest at one end to support the shoulders and head of the user when he/she is reclined on the carriage. An adjustable foot bar, foot support, or footrest against which the user places his/her feet is mounted to the foot end of the rectangular frame. The user can then push against the footrest to move the carriage along the track away from the footrest against spring tension to exercise the leg and foot muscle groups in accordance with prescribed movement routines. A carriage stop pin is typically mounted on the track near the foot end to prevent the carriage from moving too close to the footrest. These pins are typically metal pins with a sleeve made of a material, such as rubber to lessen the amount of noise made when the carriage is retracted against the stop pins.

U.S. Pat. Nos. 5,338,276, 5,607,381 and 5,681,249 disclose reformers and several footrest arrangements and adjustable headrest assemblies for this type of exercise apparatus. One of the difficulties, which the currently available reformers do not optimally address, is the portability and storability of the apparatus. Accordingly, there is a need for a reformer type of exercise apparatus that can be efficiently stored and transported without sacrificing quiet operation and full reformer capabilities.

SUMMARY OF THE INVENTION

The reformer exercise apparatus in accordance with embodiments of the present invention addresses the above-identified limitations in conventional reformer designs. The present invention is an exercise apparatus which includes a wheeled carriage having a rigid platform and a generally flat top surface. The carriage is movably mounted on parallel track members of a generally rectangular telescopically collapsible frame, which has a head end and a foot end. The carriage has a pair of upwardly extending shoulder stops mounted thereto at one end and a headrest between the shoulder stops that extends outward from the carriage toward the head end of the frame. A plurality of elastic members may be selectively connected between the foot end and the carriage to elastically bias the carriage toward the foot end of the frame.

The frame primarily comprises a pair of telescoping rail member assemblies spaced in parallel relation by a foot end support member and a head end support member. Each of the rails includes a tubular female section and a male section that fits into the female section. A spring support bracket fastened at the foot end of the frame is used to selectively receive one end of each of a plurality of springs. The other end of each of the springs is fastened to the carriage to elastically bias the carriage toward the foot end of the frame.

The head end of the frame supports a pair of rope or cord pulleys to permit the carriage to travel against spring tension the full length of the extended parallel rails or tracks by the user pulling ropes each having one end fastened to the head end of the carriage and running through one of the pulleys. In addition, the head end has a central bridge member which holds the head ends of the tracks apart, supports the pulleys, and incorporates a hand grip for pulling the collapsed reformer along a travel surface.

The carriage assembly is captured between the rail members by roller wheel and guide roller assemblies in which four roller wheels ride on top of the rails. The guide rollers ride along the inside vertical walls of the rails to center the carriage between the rails, prevent binding of the carriage on the rail members and minimize friction between the carriage and the rails.

For storage, the rail assemblies may be telescopically collapsed, capturing the carriage between the head and foot ends, and the shoulder stops can be unlatched and folded down to make a compact package that may be rolled under a bed, stored in a closet, or easily transported in a vehicle.

Other objects, features and advantages of the present invention will become apparent from a reading of the following detailed description when taken in conjunction with the accompanying drawing wherein a particular embodiment of the invention is disclosed as an illustrative example.

DETAILED DESCRIPTION OF THE INVENTION

Figure 1:
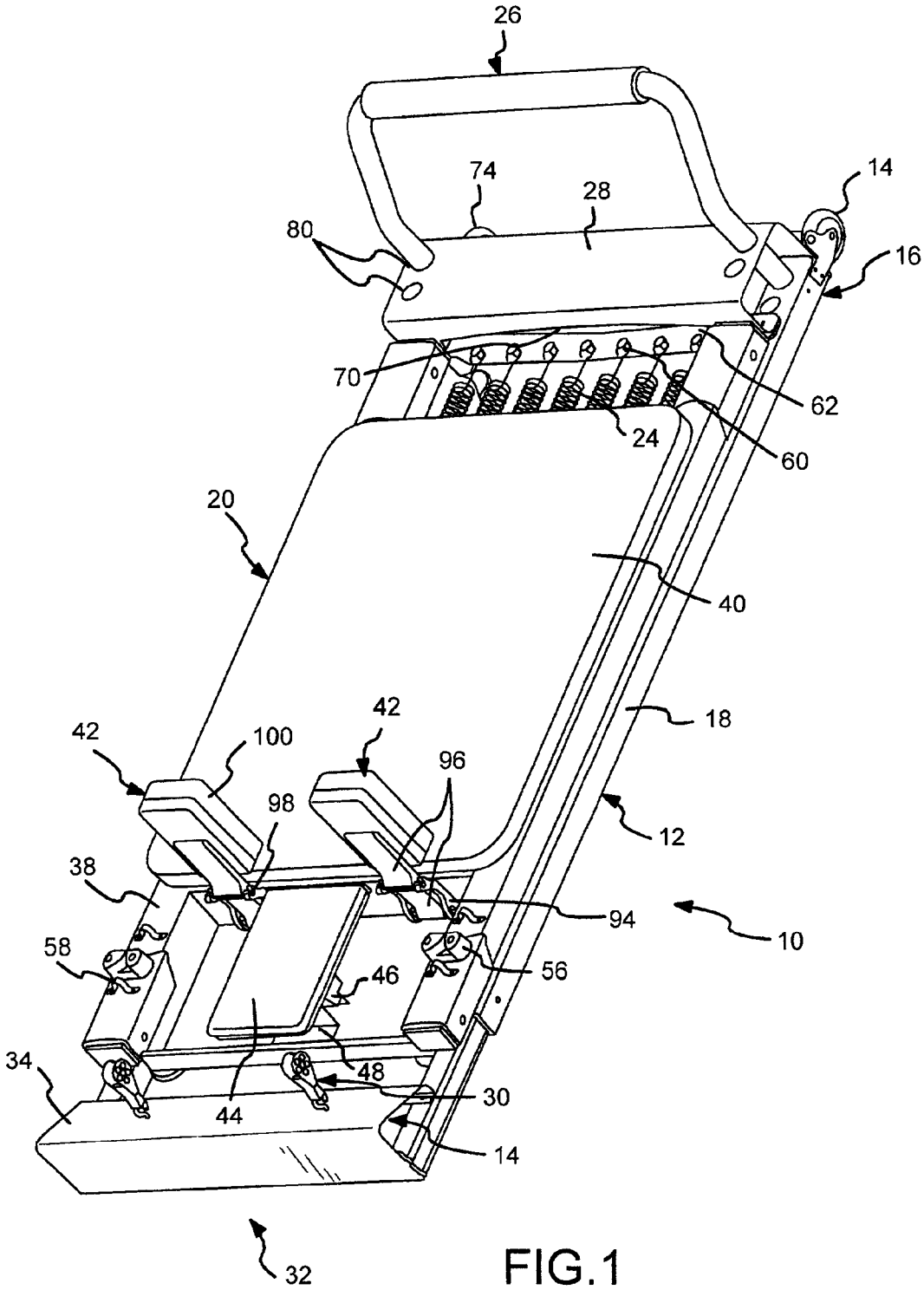
FIG. 1 is an upper perspective view of one embodiment of the reformer exercise apparatus in accordance with the present invention with the head end telescopically retracted toward the foot end of the frame.
Figure 2:
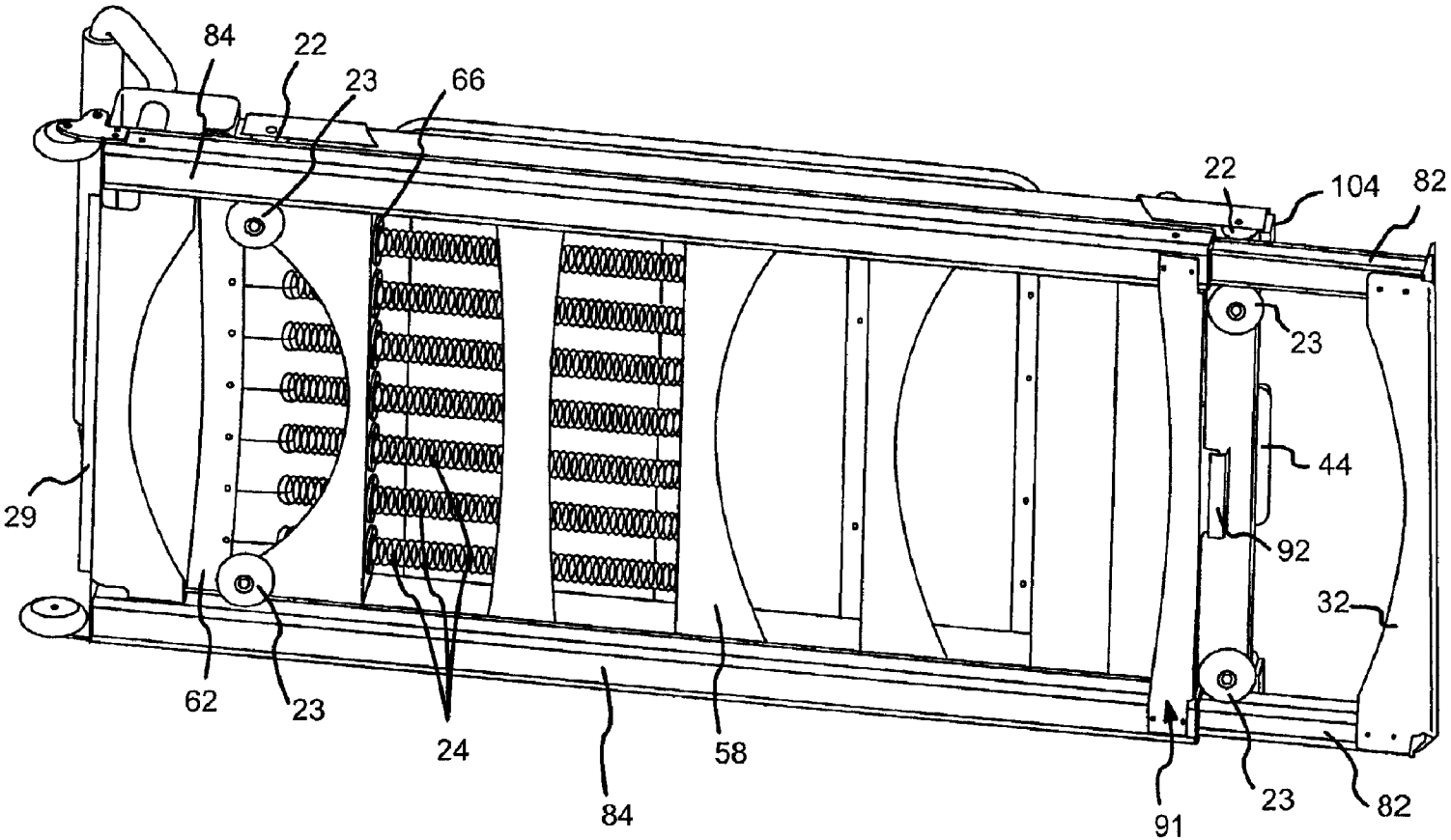
FIG. 2 is a bottom perspective view of the reformer exercise apparatus shown in FIG. 1.

A reformer exercise apparatus 10 in accordance with a preferred embodiment of the present invention is shown in upper and lower perspective views in FIGS. 1 and 2 respectively. In these views, the reformer 10 is shown fully collapsed. The exercise apparatus 10 comprises a generally rectangular frame 12 having a head end 14 and a foot end 16 and a pair of parallel track or rail member assemblies 18 separating the head end 14 from the foot end 16.

Figure 3:
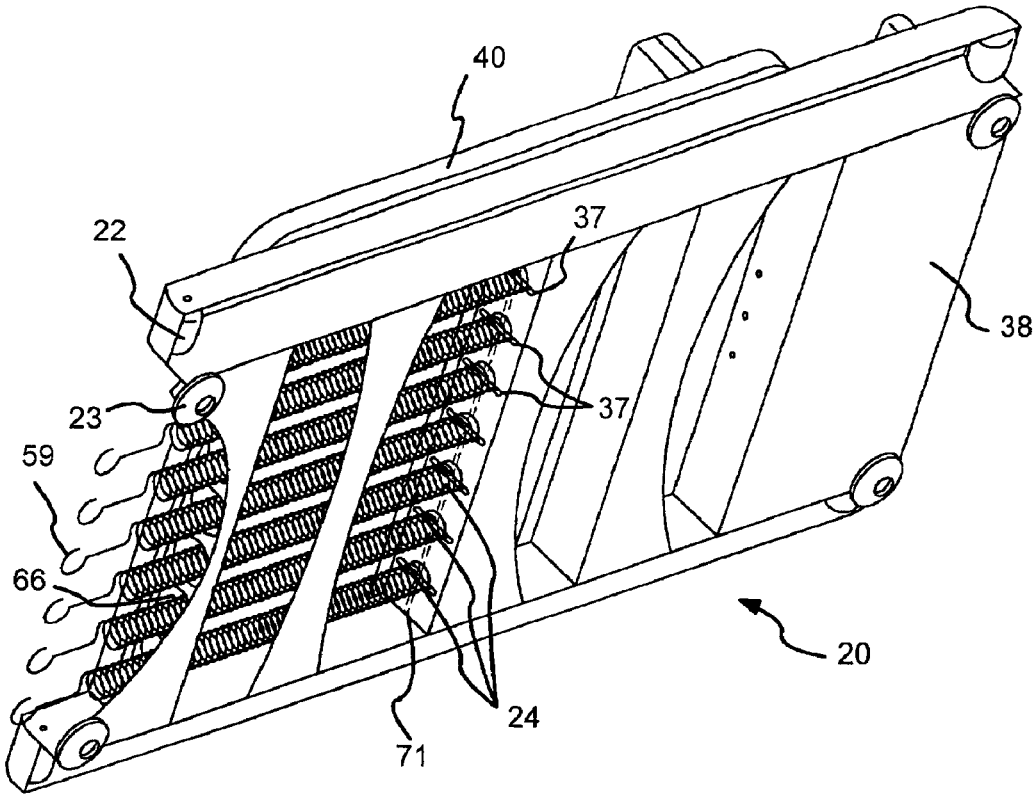
FIG. 3 is a separate bottom perspective view of the carriage assembly.

A movable carriage 20 rides on four roller wheels 22 fastened to the underside of the carriage 20 also shown in FIG. 3. The roller wheels 22 roll on the track member assemblies 18 to support and guide movement of the carriage 20 back and forth along the track member assemblies 18 of the frame 12. Up to seven elastic members, e.g., springs 24, may be selectively connected between the carriage 20 and the foot end 16 to bias the carriage 20 toward the foot end 16 with varying amounts of spring force.

Figure 7:
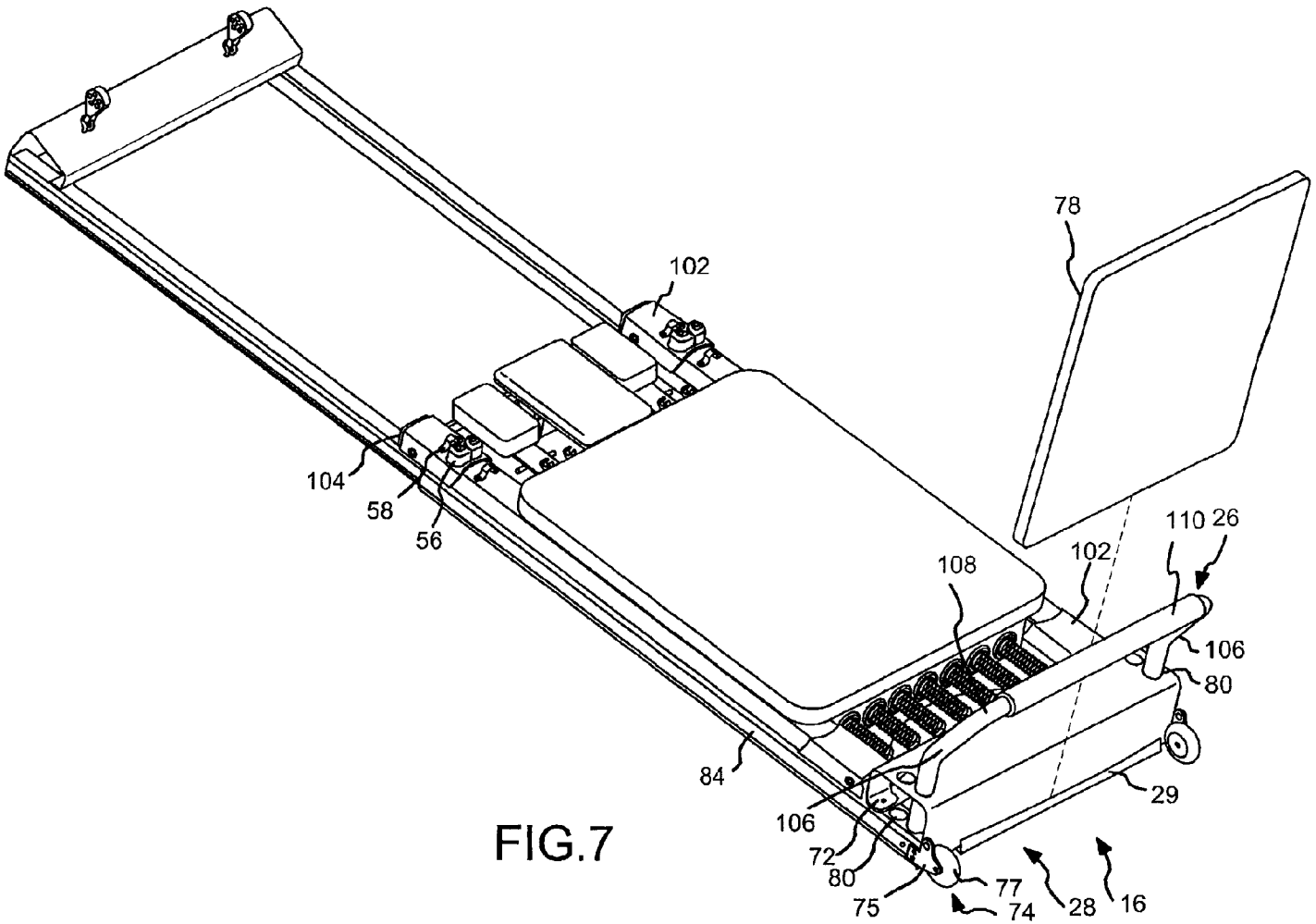
FIG. 7 is a foot end perspective view of the apparatus shown in FIG. 1 with the frame fully expanded.

A foot bar 26 is removably fastened to the frame 12 at the foot end 16 so as to provide a stationary support for a user to push against in order to move the carriage 20 back and forth along the track member assemblies 18. The foot bar 26 may be reversed and turned around and reinserted into one of two sets of apertures 80 in the foot end 16 to provide a different horizontal foot position. This moves the foot bar 26 closer to the carriage 20. Thus, there are four positions in which the user can place the foot bar 26 accommodating those users that may have shorter legs. The foot end 16 also includes a foot platform 28 for a standing user to place one foot on while the other foot is placed on the carriage 20 for standing exercises on the apparatus 10. This platform 28 is preferably made of two pieces of folded sheet material such as aluminum, aluminum alloy or rigid plastic, and more preferably of steel sheet metal, and also serves as a cross member to support and space the rail member assemblies 18 apart. The second piece of sheet metal, the jump board support 29, and foot bar 26 together provide a support for a jump board 78, the bottom of which can be placed in a channel formed by the jump board support 29. The back of the jump board rests against the foot bar 26 as shown in FIG. 7.

Figure 4:
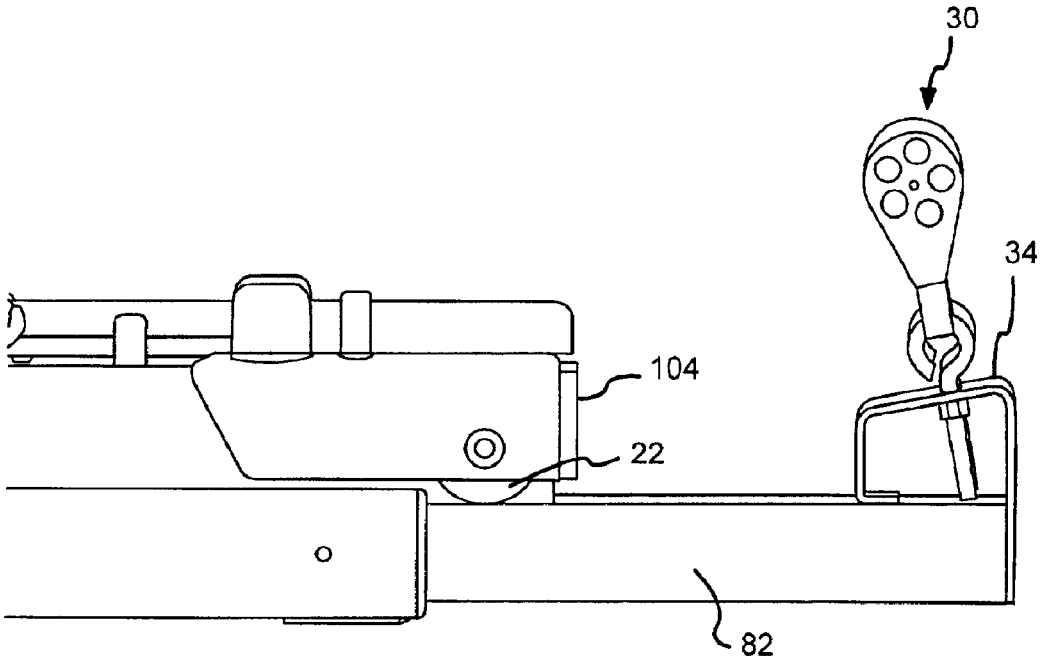
FIG. 4 is an enlarged partial side view of the head end of the reformer exercise apparatus shown in FIG. 1.

The head end 14 is designed to space the rail member assemblies 18 rigidly apart, act as a handle and support a pair of pulley assemblies 30, also shown in FIG. 4. The head end 14 has a folded sheet metal cross member 32, preferably made of steel, aluminum or an aluminum alloy, and is fastened to the head ends of the rail member assemblies 18 by a spud that receives screws securing the cross member 32 to the rails 18. The cross member 32 is preferably comprised of a vertical wall and a top wall. The ends of the rail member assemblies 18 are fastened to the vertical wall of the cross member 32, as shown in FIG. 1. The top side 34 of the cross member 32 is sloped downward and extends to the top of the rail member assemblies 18. The top side 34 of the cross member 32 is screwed or otherwise fastened to the top of the rail member assemblies 18 through the spud (not shown) located inside the head ends of the rail member assemblies 18.

The top side 34 of the tubular box cross member 32 supports a pair of pulley assemblies 30 each of which has a hand cord (not shown) threaded through the pulley 30. One end of the hand cord is adjustably fastened to the carriage 20 (not shown). The other end is typically gripped by a user during arm or leg exercises (not shown).

Referring back to FIGS. 1 and 2, the carriage 20 comprises a rigid frame 38 which has a generally rectangular shape. A flat rectangular cushion pad 40 is secured to the upper surface of the frame 38. A pair of shoulder stops 42 are spaced apart near one end of and fastened to the frame 38. These shoulder stops 42 engage a user's shoulders when the user lies on his or her back on the carriage 20 while exercising on the apparatus 10 and prevent the user from sliding toward the head end 14. A padded headrest 44 is fastened by a hinge (not shown) at a base end of the headrest 44 to the frame 38 between the shoulder stops 42. A trapezoidal shaped hinged block 46 is fastened to the underside of the headrest. This block can be moved permitting a user to adjust the incline of the headrest 44 between three positions. The hinged block 46 rests upon a metal support 48 fastened to the carriage frame 38. The hand cords (not shown) are adjustably locked between cam lock rollers 56 and pass under two sets of rope brackets 58 to secure the cords.

Figure 5:
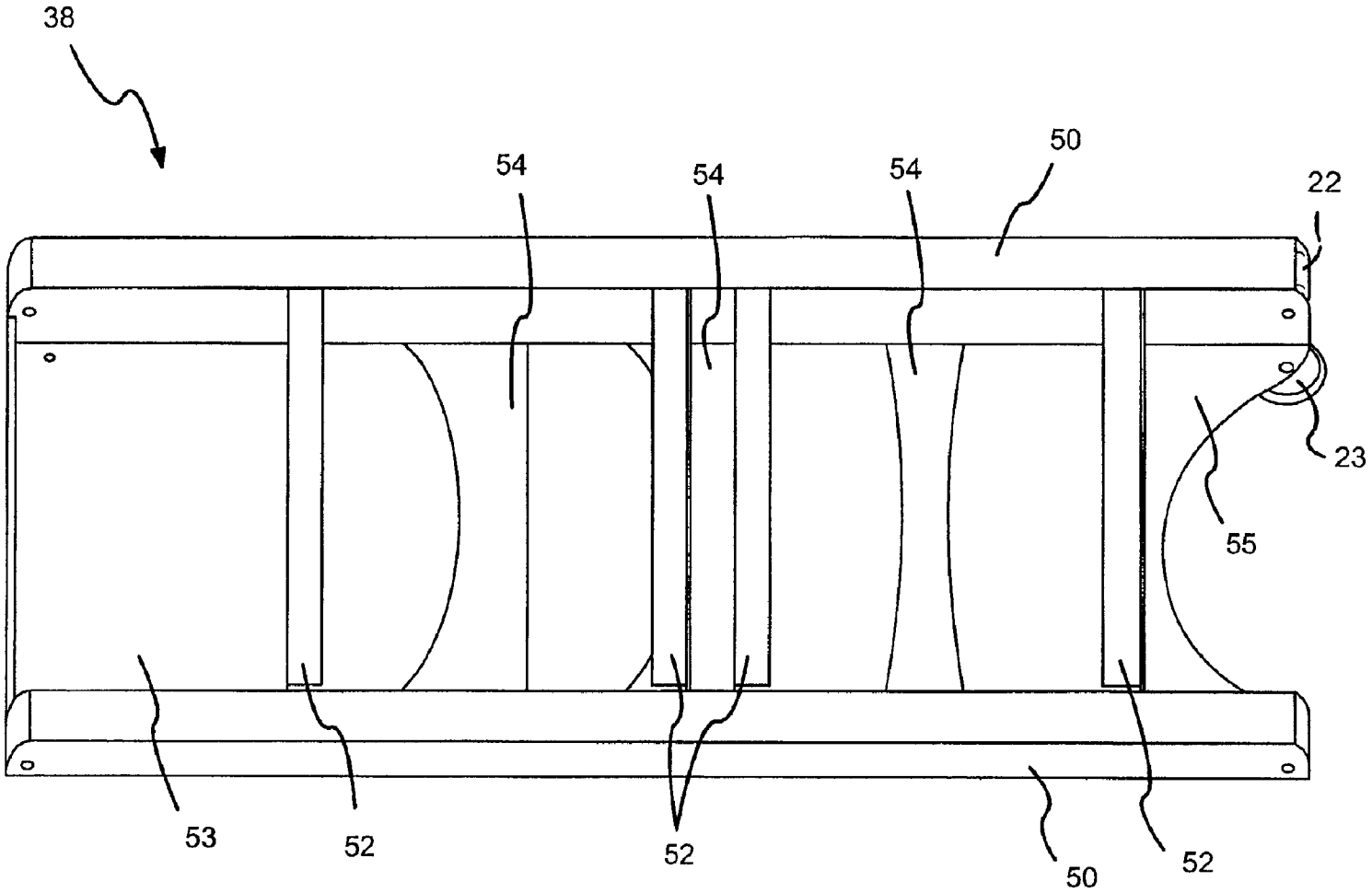
FIG. 5 is a separate bottom perspective view of the carriage frame.
Figure 6:
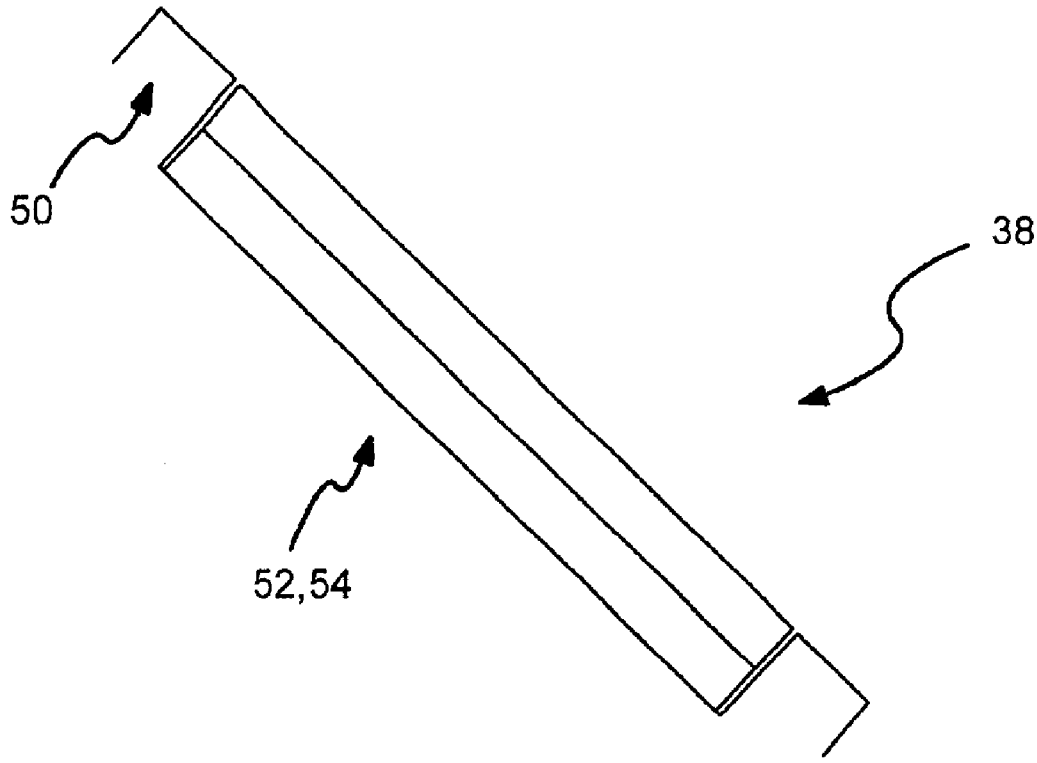
FIG. 6 is an open end view of the carriage frame shown in FIG. 5.

A separate perspective view of the carriage frame 38 is shown in FIG. 5. An end view of the frame 38 with the end pieces of the channels are removed for purposes of illustrating the shape of the channels as shown in FIG. 6. Frame 38 is formed from sheet metal which is cut and folded to form a ladder shaped carriage frame structure with a pair of spaced parallel U shaped box side channels 50. The frame 38 is preferably made of steel sheet metal. The side channels 50 are closed at the ends. A piece of sheet metal is bent down and welded to close off the ends of the channels 50. The carriage frame 38 structure has a cushion pad 40 support portion with a series of alternating transverse ribs 52 and platform portions 53, 54 and 55 spacing the channels 50 apart. After the single piece of sheet metal is cut, it is folded to form the alternating transverse ribs 52. The folded ribs 52 are welded or otherwise secured to the side channels 50. Alternatively, laser cutouts of excess material of the steel frame 38 can be removed to reduce the weight of the carriage 20. The side channels 50 receive and support one of the roller wheels 22 at each end thereof as shown in FIG. 3. The side channels 50 extend beyond the cushion pad support portion 40 to support and cover the roller wheels 22. Therefore, the roller wheels 22 are in front of or behind where the cushion pad 40 rests.

The guide wheels 23 are located beneath the platform portions 53 and 55 adjacent the roller wheels 22. One roller wheel 22 and one guide wheel 23 are shown mounted to the carriage frame 38 in FIG. 5. The roller wheel 22 is shown in FIG. 5 with dashed lines representing the carriage frame 38 having closed ends covering the roller wheels 22. The ribs 52 provide support for the carriage pad 40 and space the side channels 50 apart. One of the ribs 52 guides the springs 24 via apertures 66 through the ribs 52 toward the foot end 16 of the carriage 20. Another rib 52 has slots 37 to feed the end of the spring 24 through. The springs are held in place by a rod 71 that spans behind it. In FIG. 3, the rod 71 is shown in dashed lines representing it is behind the rib 52. At the head end of the carriage frame 38, the platform portion 53 supports the headrest 44 and shoulder stops 42 as further described below. In an alternative embodiment, the cushion pad 40 covers the entire carriage frame 38 along with the roller wheels 22 and guide wheels 23.

Referring specifically to FIG. 3 and 5, the underside of the carriage frame 38 has transverse ribs 52 formed from the sheet metal. The springs 24 are fastened to a rod 71 located directly behind one of the ribs 52. The springs 24 pass through the slots 37 in one of the ribs 52. The springs 24 also pass through apertures or holes 66 in another rib 52. The other end of each of the springs 24 has a hook or eye 59 that may be selectively fastened to a post 60 projecting from the vertical side of a spring support cross member plate 62, as shown in FIG. 1. The spring support plate 62 is attached at the foot ends of the track assemblies 18. The location of the posts 60 on the spring support plate 62 provides an anchor for the springs 24 when the carriage 20 is fully retracted toward the foot end 16. In an alternative embodiment, the spring support plate 62 may be replaced by a rod fastened to the foot end 16 (not shown).

The top of the head end platform portion 53 of the carriage frame 38 supports the headrest 44. As shown in FIG. 1, a metal support 48 is welded, fastened by screws, or otherwise secured to the head end platform portion 53. A trapezoidal shaped hinged block 46 rests on the metal support 48 and preferably, may be moved between three positions, depending on the user's preferred head level. The padded headrest 44 is bolted, or otherwise fastened to the hinged block 46. One end of the padded headrest 44 has a hinge (not shown) which is fastened to the carriage frame 38 to prevent the headrest from sliding. Preferably, the headrest 44 is fastened to the vertical portion of one of the ribs 52, as shown in FIG. 1.

Also, fastened to the upper side of the carriage frame 38 are two shoulder stops 42. Shoulder brackets 94 are fastened to the vertical portion of one of the ribs 52 of the carriage frame 38. Alternatively, the shoulder brackets 94 are L-shaped (not shown) and are bolted, fastened by screws, or otherwise fastened to the top of the head end platform 53 and fastened to the vertical portion of one of the ribs 52. The shoulder plates 96 having horizontal rods 98 slide and lock into the shoulder brackets 94. A shoulder cushion pad 100 is fastened to the top shoulder plate 96. For storage, the shoulder plates 96 can be pulled upward and laid flat on the carriage 20 while remaining secure in the shoulder brackets 94, as shown in FIG. 7. More specifically, the horizontal rods 98 are removed from the shoulder plates 96 with an upward motion. The bottom shoulder plate 96 remains secure in the bottom shoulder bracket 94 while the plates 96 and the shoulder cushion pad 100 lay flat on the head end platform portion 53 of the carriage frame 38. The shoulder plates 96 are held down on the carriage 20 by elastic cord, Velcro, or an otherwise securing means (not shown).

Referring to FIG. 7, an additional plastic cover 102 is fastened by glue, snap, screws or otherwise fastened to the ends of the side channels 50 of the carriage frame 38. The cover 102 is preferably an inverted U shaped piece of injected plastic. At the ends of the plastic covers 102 and the ends of the channels 50, are rubber stops 104, also shown in FIGS. 4 and 7. There are preferably four plastic covers 102 placed over each of the roller wheels 22 on the carriage frame 38. The rubber stops 104 allow quiet operation when the carriage hits either the foot platform 28 at the foot end or the head end cross member 32. The end of the channels 50, the plastic covers 102 and the rubber stops 104 prevent the carriage from moving too close to the foot platform 28 and the head end cross member 32.

The cam lock rollers 56 and one pair of the rope brackets 58 are fastened to the top of the plastic covers 102 at the head end of the carriage frame 38. Another pair of rope brackets 58 are fastened by screws or otherwise fastened to the top of the carriage frame 38 next to the cam lock rollers 56, as shown in FIGS. 1 and 7.

Referring to FIG. 7, the foot end 16 is preferably a folded platform 28 of sheet material such as steel, aluminum or aluminum alloy which is generally rectangular and has a C shaped cross section. Side 72, facing the carriage 20, includes a cutout 70 to permit the user to access, i.e., reach beneath and position springs 24 on the posts 60 on the spring support cross member plate 62 as can be envisioned with reference to FIG. 1. The outer ends of side 72 and the ends of the spring support plate 62 are fastened to the top of the rail member assemblies 18 by threaded fastens, adhesive bonding, welding or other suitable means. A separate piece of sheet metal, the jump board support 29, is attached to the bottom of the rail member assemblies 18, as shown in FIG. 2. The jump board support 29 is folded to provide a channel in which the jump board 78 can be placed securely. The jump board support 29 supports a bottom edge of a removable jump board 78 as shown in FIG. 7.

The foot end platform 28 further acts as a horizontal foot support. Adjacent each end of the top of the platform 28, are apertures 80 through which the legs of the removable foot bar 26 are placed. The foot bar 28 can be placed in one of the two sets of apertures 80 in the foot end platform 28, as shown in FIGS. 1 and 7. The foot bar 26 is then fastened to the rail assemblies 18. The legs of the foot bar assembly 26 may be inserted through apertures 80 in the rail member assemblies 18, which in turn are inserted into apertures in a spud (not shown). The spud (not shown) is placed inside the foot end of the rail members 18. The foot bar 26 is held in place by the spud and fastened by foot bar pins which are inserted through the rail assemblies 18 and into the spud (not shown).

As shown in FIGS. 1 and 7, a pair of wheel assemblies 74 are fastened to the rail assemblies 18. The wheel assemblies 74 include a wheel assembly sheet metal support bracket 75 which is fastened to the rail member assemblies 18 and the spud (not shown) preferably by screws or otherwise fastened. The wheel assembly support bracket 75 secures a wheel 77. These wheel assemblies 74 permit the apparatus 10 to be easily transported by simply lifting the head end 14 until the wheels 77 engage the ground and then rolling the apparatus 10 as one would roll a wheelbarrow.

The removable foot bar assembly 26 comprises a general U shaped foot bar, preferably made of steel sheet metal, having a pair of spaced bent leg portions 106 and a foot bar portion 108 therebetween as shown in FIG. 7. The bend in the parallel leg portions 106 allows the user to place the foot bar assembly with the bend toward the carriage 20 or alternatively, away from the carriage 20. A padded sleeve 110 over the foot bar portion 108 provides a cushion support for a user's foot. The foot bar assembly 26 is shown in FIGS. 1, 2 and 7 assembled through the apertures 80 in the foot platform 28 and onto the rail member assemblies 18 at the foot end 16 of the frame 12.

Figure 8:
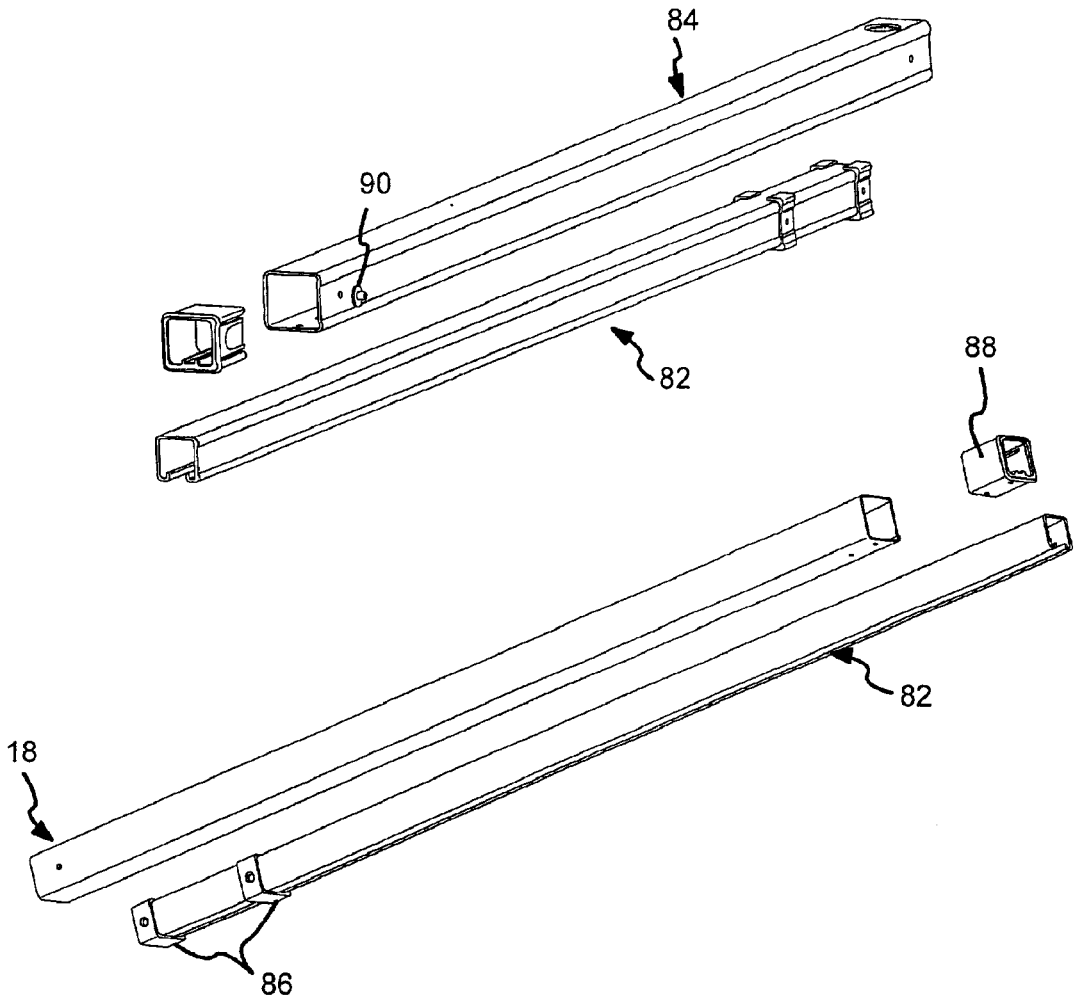
FIG. 8 is a separate exploded view of a pair of telescopic rail assemblies in accordance with the invention.

The rail member assemblies 18, preferably made of aluminum, steel or an aluminum alloy, are composed of a foot end rail member 84 and a head end rail member 82 as shown in FIG. 8. The head end rail members 82 telescopically retract into foot end rail members 84. The foot end rail member 84 is a tubular box extrusion with open ends. Preferably, spuds are used to screw in one end of the foot end rail member 84 to the foot platform 28. The bottom of side 72 of the foot end platform 28 facing the carriage and the spring support plate 62 are fastened to the top of the foot end rail member 84 by threaded fastens, adhesive bonding, welding or other suitable means. The spuds also fasten the foot end rail member 84 to the jump board support 29 (not shown).

To the other end of the foot end rail member 84 is an external guide bushing 88. This is shown in FIG. 8. Part of the external guide 88 fits into the end of the foot end rail member 84 and the external guide 88 has a lip portion that fits around the outside edges of the foot end rail member 84. The external guide bushing 88 has a top wall, two vertical walls and a bottom wall. The bottom wall of the external guide 88 has two grooves which provide guides for the head end rail member 82.

The head end rail member 82 is an inverted U channel extrusion consisting of two side walls, a top wall and an open bottom. The ends of the side walls are curved to form a foot that fits into the grooves of the external guide 88. The head end rail member 82 slides comfortably through the external guide bushing 88 and into the foot end rail member 84 due to the foot and groove alignment providing quiet, smooth movement.

One end of the head end rail member 82 is bonded, welded or otherwise fastened to the head end tubular box cross member 32. Preferably, the end of the head end rail member 82 has a spud insert (not shown) which allows the cross member 32 to be screwed into and securely fastened to the rail member. At the opposite end of the head end rail member 82 are two internal guide bushings 86, as shown in FIG. 8. The internal guides 86 are C shaped and clip onto the outside of head end rail member 82 and can be fastened by a screw and T-nut. The internal guides 86 fit along the inside of the foot end rail member 84 which allows the head end rail member 82 to move smoothly along the inside of the foot end rail member 84. In an alternative embodiment, the head end rail member is a tubular box extrusion with open ends (not shown).

The internal 86 and external guides 88 are preferably made of injected molded or other substantially rigid, tough material. The guides 86 and 88 can be fastened by screws and a T-nut or otherwise fastened to the rail member assemblies 18. When the head end rail member 82 and the foot end rail member 84 are joined, the external guide 88 may be hand tightened by the foot end rail member pin 90 which pushes the guide against the head end rail member 84 and eliminates play in the rails. The pin 90 is located on the outside of the foot end rail member 84 also shown in FIG. 8.

A carriage stop cross member 91 is fastened by screws, bolted or otherwise fastened to the bottom of the foot end rail members 84 as shown in FIG. 2. This cross member 91 is located at the head end of the foot end rail members 84. Also, as shown in FIG. 7 and discussed above, fastened to the ends of the foot end rail members 84 are wheel assemblies 74 comprised of a sheet metal support bracket 75 and a wheel 77. The support bracket 75 is bolted or otherwise fastened to the foot end rail member 84 and the wheels 77 are fastened to the support bracket 75 on a horizontal axis. The wheel assemblies 74 provide easy transportation of the exercise apparatus 10 to a storage location.

Referring now to FIGS. 2 and 4, construction of the carriage 20, roller wheels 22 and guide wheels 23 will be described. The roller wheels 22 are fastened to the underside of the side channels 50 of the carriage frame 38 via screws, a pin, or otherwise fastened. When set in motion the head end roller wheels 22 move along the top of the head end rail member 82 and the foot end roller wheels 22 move along the top of the foot end rail member 84. Due to the extra height of the foot end rail member 84, the head end roller wheels 22 are mounted lower than the foot end roller wheels 22 so that the carriage lays evenly parallel with the ground. In other words, if the carriage 20 and roller wheels 22 were set on a flat surface, the head end of the carriage 20 would be higher than the foot end. In an alternative embodiment, the roller wheels could be made bigger to adjust for the different rail member heights.

The roller wheels 22 are elongated cylindrical wheels mounted on a horizontal axis. The guide wheels 23 are round wheels mounted on a vertical axis. The guide wheels 23 are fastened to the underside of the carriage platform portions 53 and 55, as shown in FIGS. 3 and 5, at a vertical axis, and the guide wheels 23 move along the inside rail members 18. The head end guide wheels 23 are mounted at the underside of the carriage frame and roll along the inside of the head end rail member 82. Since the head end rail member 82 is smaller in size than the foot end rail member 84, the head end guide wheels 23 will be mounted at a different location than the foot end guide wheels 23 on the carriage frame. The head end guide wheels 23 move along the inside of the head end rail members 82 and the foot end guide wheels 23 move along the inside of the foot end rail members 84. The guide wheels 23 ensure that minimal friction is exerted between the carriage 20 and the rail members 18 for an exceptionally smooth back and forth movement of the carriage 20 on the rail members 16 of the apparatus 10 during use.

For transport, one telescopically compacts the head end rail member 82 into the foot end rail member 84 at a locked position, removes the foot bar assembly 26 from the foot platform 28, retracts the shoulder stops 42 to a flat position, and places the compacted apparatus in one's vehicle, closet or under a piece of furniture. More specifically, the exercise apparatus 10 is less than 60 inches long in its collapsed state so that it will fit under a bed while allowing the carriage 20 to travel approximately 40 inches when the frame is in its extended state. Each of the guide wheels 23 and roller wheels 22 rest upon either the head end rail members 82 or the foot end rail member 84 when the apparatus is fully retracted for storage. The spring support cross member 62 has tabs (not shown) that lock over the carriage frame 38 preventing the carriage from coming off of the rail assembly 18.

Figure 9:
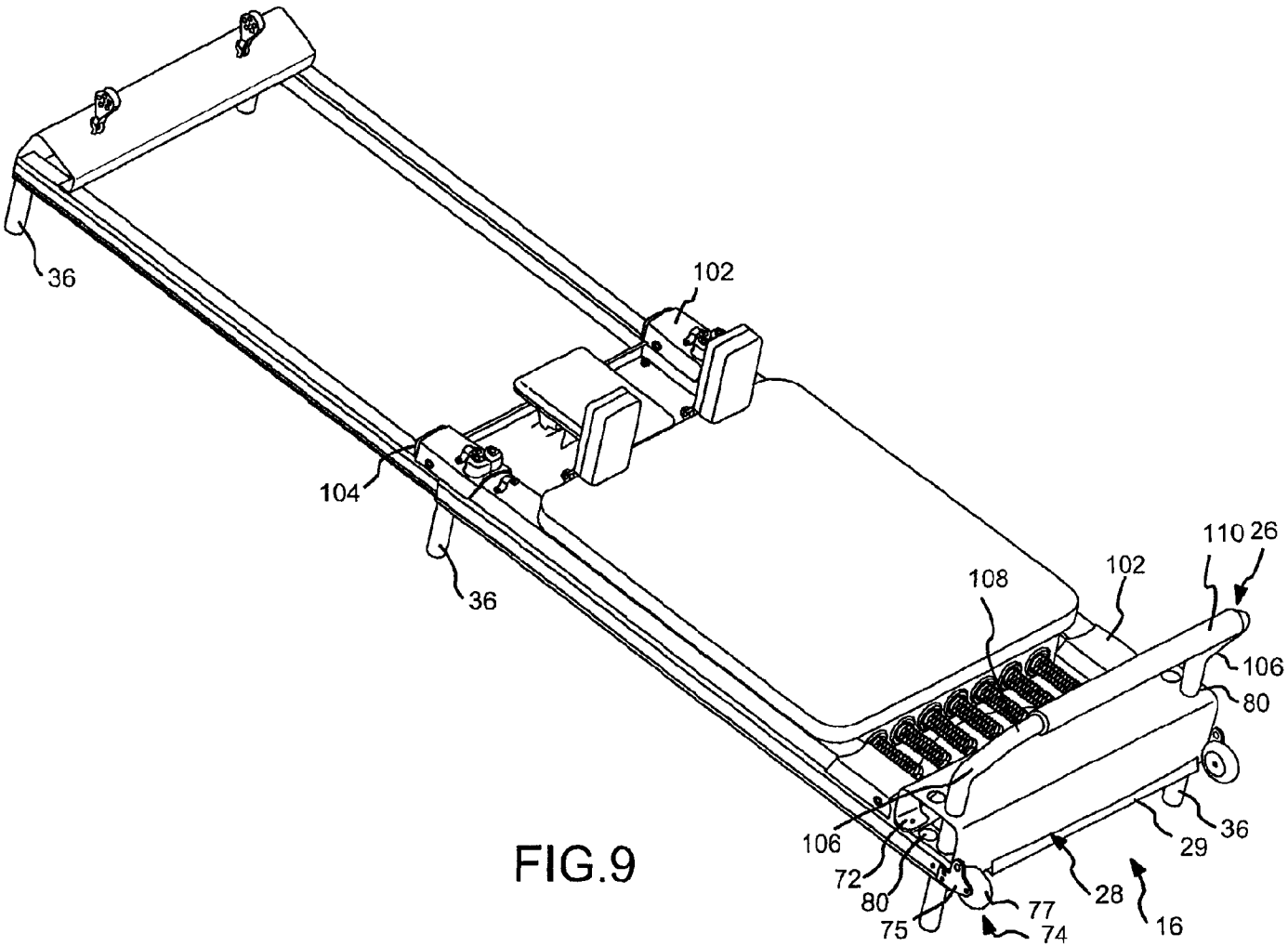
FIG. 9 is foot end perspective view of another embodiment of the reformer exercise apparatus in accordance with the present invention with frame fully expanded.

In an alternative embodiment, as shown in FIG. 9, legs 36 are attached to the frame 12. Up to six legs 36 are fastened to the underside of the frame 12 which raises the frame 12 and the exercise apparatus 10 off of the ground. This provides easier use for an assistant, such as a personal trainer or physical therapist, to assist the user on the exercise apparatus 10. The legs 36 are retractable and are snapped, bolted, or otherwise fastened to the frame 12. Legs 36 are fastened to each corner of the frame 12, more specifically, two legs 36 are fastened to the underside of each of the head end rail members 82 and two legs 36 are fastened to the underside of each of the foot end rail members 84. Up to two legs 36 can be fastened to the underside of the carriage stop cross member 91 which is fastened to the head end of the foot end rail members 84. Thus, the legs 36 fastened to the carriage stop cross member 91 are located in the middle of the frame 12 and provide support for the center of the exercise apparatus 10 as shown in FIG. 9. Alternatively, the legs 36 can be removable from the frame 12.

Accordingly, the invention may be practiced other than as specifically described and shown herein with reference to the illustrated embodiments. The present invention is not intended to be limited to the particular embodiments illustrated but is intended to cover all such alternatives, modifications, and equivalents as may be included by the following claims. All patents, patent applications, and printed publications referred to herein are hereby incorporated by reference in their entirety.

What is claimed is:

1. A reformer exercise apparatus comprising:

a generally rectangular frame having a head end, a foot end and a pair of spaced apart parallel track members therebetween;

a movable carriage mounted on the rectangular frame for movement along the track members between the head and foot ends, the carriage having a carriage frame made of sheet material folded to form two parallel spaced channels that fit on the track members and a plurality of transverse ribs extending between the channels, wherein the carriage frame has a plurality of horizontal platform portions perpendicular to and spaced between the ribs, each platform portion extending between the channels; and a plurality of elongated elastic members extending between the carriage and the foot end of the rectangular frame.

2. A reformer exercise apparatus comprising:

a generally rectangular frame having a head end, a foot end and a pair of spaced apart parallel track members therebetween;

a movable carriage mounted on the rectangular frame for movement along the track members between the head and foot ends, the carriage having a carriage frame made of sheet material folded to form two parallel spaced channels that fit on the track members and a plurality of transverse ribs extending between the channels, wherein the carriage frame has one of the platform portions supporting a headrest; and a plurality of elongated elastic members extending between the carriage and the foot end of the rectangular frame.

3. A reformer exercise apparatus comprising:

a generally rectangular frame having a head end, a foot end and a pair of spaced apart parallel track members therebetween;

a movable carriage mounted on the rectangular frame for movement along the track members between the head and foot ends, the carriage having a carriage frame made of sheet material folded to form two parallel spaced channels that fit on the track members and a plurality of transverse ribs extending between the channels, wherein the carriage frame has one of the ribs supporting a pair of shoulder stops; and a plurality of elongated elastic members extending between the carriage and the foot end of the rectangular frame.

4. A reformer exercise apparatus comprising:

a generally rectangular frame having a head end, a foot end and a pair of spaced apart parallel track members therebetween;

a movable carriage mounted on the rectangular frame for movement along the track members between the head and foot ends;

the carriage having a carriage frame made of sheet material folded to form two parallel spaced channels that fit on the track members and a plurality of transverse ribs extending between the channels; and a plurality of elongated elastic members extending between the carriage and the foot end of the rectangular frame, wherein the elongated elastic members are a plurality of springs with one end of each of the springs attaching to a first rib of the carriage frame, and a second end of each of the springs removably attaching to a spring support cross member extending between the track members at the foot end of the rectangular frame, and wherein a second rib provides a support for each of the springs when the second end is dismantled from the spring support cross member.

5. A reformer exercise apparatus comprising:

a generally rectangular frame having a head end, a foot end and a pair of spaced apart parallel track members therebetween;

a movable carriage mounted on the rectangular frame for movement along the track members between the head and foot ends; the carriage having a carriage frame made of sheet material folded to form two parallel spaced channels that fit on the track members and a plurality of transverse ribs extending between the channal;

a plurality of elongated elastic members extending between the carriage and the foot end of the rectangular frame; and a pair of weight bearing roller wheels mounted in each of the channels of the carriage frame for rolling along upper surfaces of the track members, the carriage frame supporting a guide wheel adjacent each roller wheel, each guide wheel positioned to roll against a side wall of one of the track members.

6. An exercise apparatus comprising:

a generally rectangular frame having a head end, a foot end and a pair of spaced apart parallel track members therebetween;

a movable carriage mounted on the rectangular frame for movement along the track members between the head and foot ends;

a pair of foldable shoulder stops, each fastened to a pair of support brackets mounted on the carriage; and a plurality of elongated elastic members extending between the carriage and the foot end to bias the carriage toward the foot end of the rectangular frame.

7. The shoulder stops of claim 6 wherein each pair of brackets are fastened to a vertical portion of the carriage.

8. An exercise apparatus comprising:

a generally rectangular frame having a head end, a foot end and a pair of spaced apart telescopically collapsible parallel track members therebetween;

a movable carriage mounted on the track members for movement along the track members between the head and foot ends, wherein the carriage is captured on the track members when the track members are fully collapsed; and a plurality of elongated elastic members extending between the carriage and the foot end biasing the carriage toward the foot end of the rectangular frame.

9. The exercise apparatus of claim 8 further comprising:

a cross member fastened to the foot end of the rectangular frame; and a pair of guide wheels mounted on the carriage, each positioned to roll against a side of one of the track members, wherein the carriage frame is captured by the cross member when the track members are fully collapsed to hold the carriage on the track members.

10. The exercise apparatus according to claim 9, wherein the cross member supports one end of each of the elastic members.

11. The exercise apparatus of claim 9, wherein each of the track members has an elongated head end rail member telescopically received in a tubular foot end member and a carriage stop cross member fastened between the foot end members maintaining the foot end members in a parallel relation.

12. The exercise apparatus of claim 11 wherein a portion of the carriage engages the spring support cross member to capture the carriage on the track members when the track members are collapsed.

13. An exercise apparatus comprising:

a generally rectangular frame having a head end, a foot end and a pair of spaced apart parallel track members therebetween, each track member having a head end rail member telescopically received in a tubular foot end rail member;

a movable carriage mounted on the track members for movement along the track members between the head and foot ends;

the carriage having a sheet metal frame folded to form two spaced parallel channels that fit over the track members, a plurality of platform portions, and a plurality of transverse ribs between the channels; and a first set of roller wheels mounted to an underside of the carriage frame rolling on the head end rail member, and a second set of roller wheels mounted to the underside of the carriage frame rolling on the foot end rail members.

14. The exercise apparatus of claim 13 wherein the roller wheels are located at each end of the channels of the carriage frame.

15. The apparatus of claim 13 further comprising a carriage pad positioned on the carriage frame wherein the channels extend beyond the carriage pad; and each of the ends of the channels has a resilient bumper to minimize shock loads when the carriage frame bumps with the head end or the foot end of the rectangular frame.

16. The exercise apparatus of claim 13 wherein a carriage stop cross member is fastened to the underside of the head end of each of the foot end rail member and spans between the foot end rail members to maintain the foot end rail members in a parallel relation.

17. The exercise apparatus of claim 13 wherein each foot end rail member has an external guide around an open end of the foot end rail member; and an internal guide located on the head end rail member within the foot end rail member, the external guide and internal guide allows smooth movement for the head end rail member along an inside of the foot end rail member.

18. The exercise apparatus of claim 17 wherein the foot end rail member has a rail member pin which a user can tighten to allow smooth movement of the head end and foot end rail members.

19. The exercise apparatus of claim 13 wherein the track members and are made of aluminum and the carriage frame is made of steel sheet metal.

20. An exercise apparatus comprising:

a generally rectangular frame having a head end, a foot end and a pair of spaced apart parallel track members therebetween;

a movable carriage mounted on the rectangular frame for movement along the track members between the head and foot ends;

a plurality of elongated elastic members extending between the carriage and the foot end of the rectangular frame;

the foot end comprising a folded sheet metal body having a horizontal platform portion and a vertical end wall portion and a separate piece forming a channel extruding from the foot end for supporting a removable jump board; and a removable U shaped foot support bar supported by the foot end sheet metal body.

21. The exercise apparatus of claim 20 wherein the foot bar has a pair of bent legs.

* * * * *